US006908206B1

(12) United States Patent
Pinciaro

(10) Patent No.: US 6,908,206 B1
(45) Date of Patent: Jun. 21, 2005

(54) ILLUMINATED ARTICLES

(76) Inventor: Fred J. Pinciaro, P.O. Box 3130, Truth or Consequences, NM (US) 87901

( * ) Notice: Subject to any disclaimer, the term of this patent is extended or adjusted under 35 U.S.C. 154(b) by 126 days.

(21) Appl. No.: 10/382,201

(22) Filed: Mar. 4, 2003

Related U.S. Application Data

(63) Continuation-in-part of application No. 09/992,131, filed on Nov. 15, 2001.

(60) Provisional application No. 60/249,404, filed on Nov. 15, 2000, provisional application No. 60/404,189, filed on Aug. 16, 2002, provisional application No. 60/392,981, filed on Jun. 28, 2002, provisional application No. 60/361,973, filed on Mar. 4, 2002.

(51) Int. Cl.[7] ..... F21K 2/00

(52) U.S. Cl. ..... 362/34; 362/84; 362/570; 362/806

(58) Field of Search ..... 362/34, 84, 103–105, 362/107, 108, 570, 571, 565, 806; 40/542, 40/546, 124.02

(56) References Cited

U.S. PATENT DOCUMENTS

| | | | | |
|---|---|---|---|---|
| 4,061,910 A | * | 12/1977 | Rosenfeld | 362/34 |
| 4,975,809 A | * | 12/1990 | Ku | 362/31 |
| 5,557,869 A | * | 9/1996 | Douglas | 40/542 |
| 5,809,678 A | * | 9/1998 | Douglas | 40/542 |
| 5,881,481 A | * | 3/1999 | Bashaw et al. | 40/593 |
| 5,951,158 A | * | 9/1999 | Upah | 362/571 |

* cited by examiner

*Primary Examiner*—Sandra O'Shea
*Assistant Examiner*—Mark Tsidulko
(74) *Attorney, Agent, or Firm*—Deborah A. Peacock; Peacock Myers & Adams, P.C.

(57) ABSTRACT

Illuminated items including a chemiluminescent article. The present invention is directed to various clothing, ornamental and useful items lighted by a chemiluminescent article, preferably a light stick that is activated. Clothing items illuminated by the chemiluminescent article include a hat, cap, shirt, pants, collar, cuff, sleeve, pocket, trim, scarf, boa, sandal and shoe. Ornamental and useful items illuminated by the chemiluminescent article include a holiday ornament, jewelry, greeting card, aquarium figure, lighter, egg, basket, flag, umbrella, guitar pick, drumstick, slide viewer, bottle topper and candy wrapper.

24 Claims, 29 Drawing Sheets

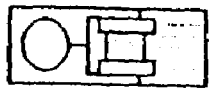
FIG. 1D
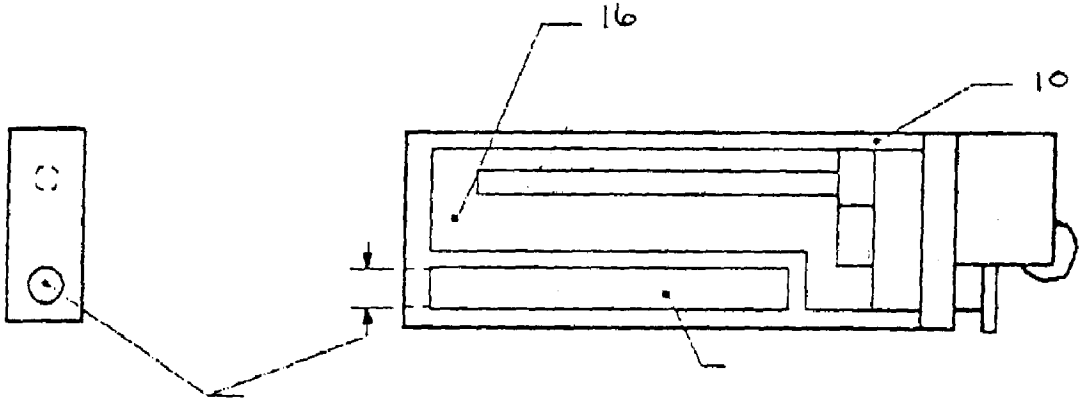
FIG. 1A
FIG. 1C
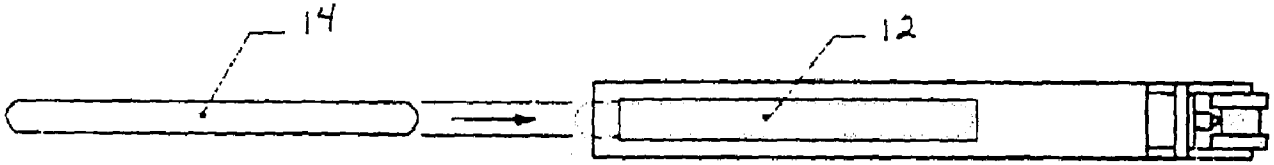
FIG. 1B

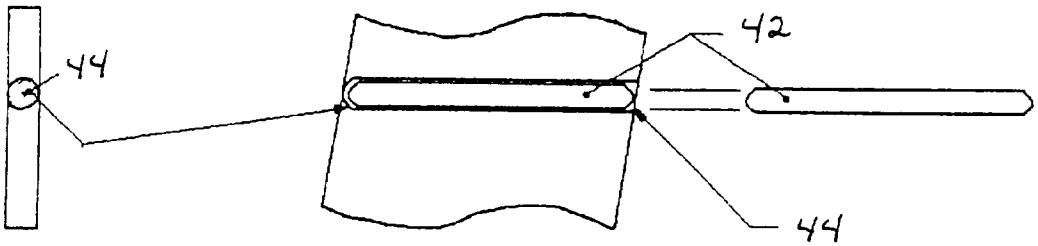
FIG. 5C
FIG. 5B
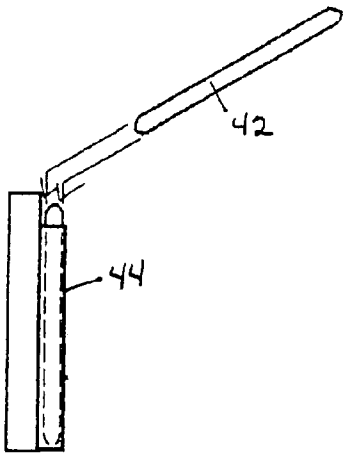
FIG. 5D
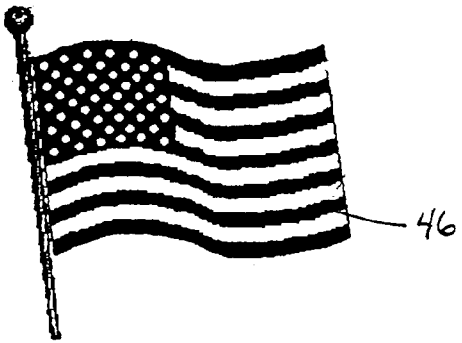
FIG. 5A

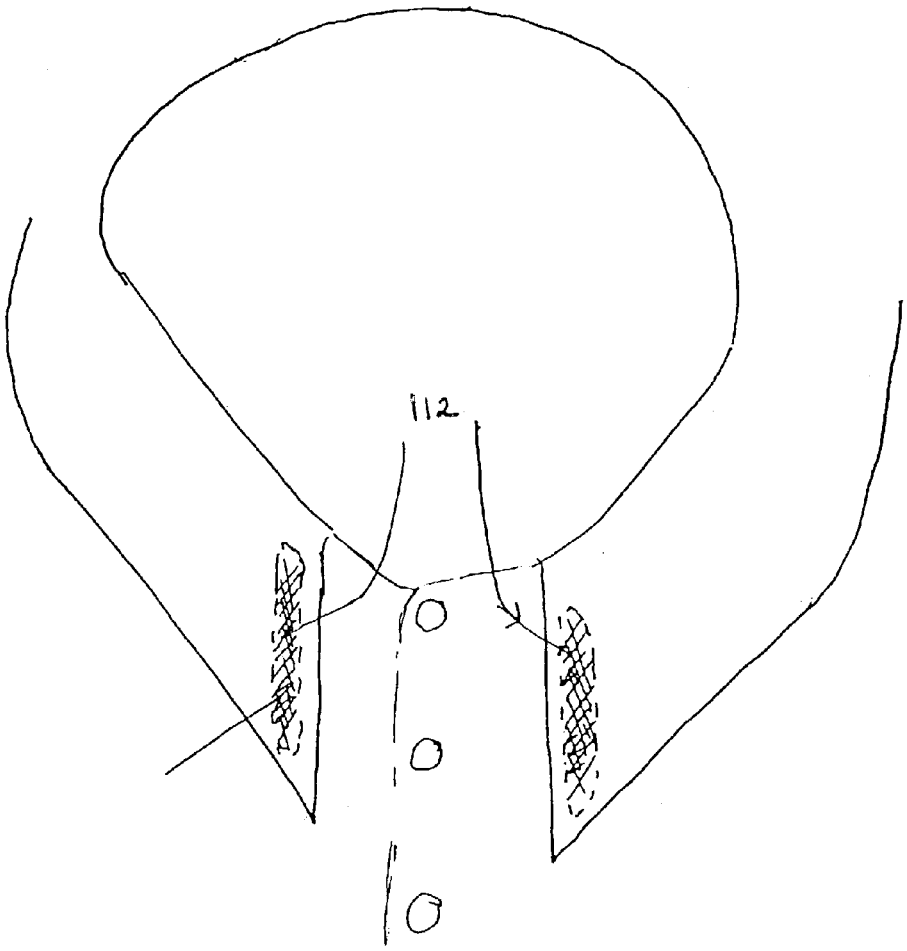
FIG. 16
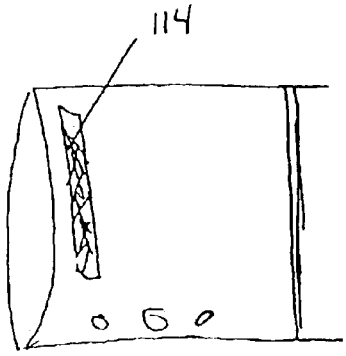

ILLUMINATED ARTICLES

CROSS-REFERENCE TO RELATED APPLICATIONS

This application is a continuation-in-part application of U.S. Utility patent application Ser. No. 09/992,131 which claimed priority to U.S. Provisional Patent Application Ser. No. 60/249,404, entitled "Lighted Jewelry" filed on Nov. 15, 2000. This application is related to and claims priority to U.S. Provisional Patent Application Ser. No. 60/361,973, entitled "Lighted Articles," filed on Mar. 4, 2002, U.S. Provisional Patent Application Ser. No. 60/392,981 entitled "Illuminated Greeting Cards, Shopping Bags and Disposable Jewelry Items" filed on Jun. 28, 2002 and U.S. Provisional Patent Application Ser. No. 60/404,189, entitled "Illuminated Articles," filed Aug. 16, 2002. The specification and claims of each of the above-identified claims are incorporated herein by reference.

COPYRIGHTED MATERIAL

© 2002 Fred James Pinciaro. A portion of the disclosure of this patent document and of the related applications listed above contains material that is subject to copyright protection. The owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

1. Field of the Invention (Technical Field)

The present invention relates to decorative lighting in greeting cards, shoes, hats, illuminated decorations (including those for jewelry items, hanging, or stationary ornaments), flashlights, wreaths, spinning toys, gun sights, lighters, toys, and novelty items by use of chemiluminescent materials or other lighting to illuminate the items.

2. Description of Related Art

Prior art devices typically use battery-powered lighting to illuminate the device. Alternatively, chemiluminescent light sticks are used separately as devices or jewelry, themselves.

In contrast, the embodiments of the present invention use chemiluminescent light sticks or materials in order to provide lighting or act as a decorative feature for the embodiments.

BRIEF SUMMARY OF THE INVENTION

The present invention relates to various illuminated items that are illuminated by a chemiluminescent article, preferable a light stick.

The invention comprises an illuminated item of clothing comprising a clothing article, a pocket comprising a transparent, translucent, opaque or cut-out face and for receiving a chemiluminescent article; and a chemiluminescent article removably disposable within the pocket and illuminating the face of the pocket when the chemiluminescent article is activated. The clothing may be a hat, cap, shirt, pants, collar, cuff, sleeve, pocket, trim, scarf, boa, shoe or sandal. The face may comprise a mesh material. The face may comprise a decorative item to be illuminated. The clothing may comprise at least one holder for holding and storing at least one unactivated additional light stick.

Other illuminated items of the invention comprise a greeting card, holiday ornament, aquarium figure, lighter, egg, basket, flag umbrella, guitar pick, drumstick, slide viewer, bottle topper jewelry and candy wrapper. These items comprise an opening for receiving a chemiluminescent article, and a chemiluminescent article removably disposable within the opening and illuminating the item when the chemiluminescent article is activated. The item may further comprise light openings for allowing light from the activated chemiluminescent article to shine through.

The greeting card of the invention comprises a front page, a backing, a transparent, translucent or opaque film, a reflective film, an opening for receiving a chemiluminescent article; and a chemiluminescent article for removably disposing with the opening and for lighting the greeting card when activated.

The invention further comprises an illuminated item comprising an item to be illuminated, at least one chemiluminescent article; and at least one fiber optic strand lighted by the chemiluminescent article.

The item may comprise jewelry, such as a necklace or bracelet, or clothing, such as a scarf, boa, collar and trim. The item may also further comprise at least one ornament distant from the chemiluminescent article and connected to the fiber optic strand and lit by the chemiluminescent article via the fiber optic strand.

The invention further comprises a geometric shape comprising a collapsed and flat unfolded form and an assembled three-dimensional form, an opening for receiving a chemiluminescent article, and a chemiluminescent article removably disposable within the opening for lighting the item in its assembled state when the chemiluminescent item is activated. The form may further comprise light openings for allowing light from the activated chemiluminescent article to shine through. This illuminated item may comprise jewelry. The assembled form may comprise a shape such a box, heart, star, animal, cartoon character, shamrock, tree, egg, or holiday shape. The illuminated item may further comprise a cut-out. The illuminated item may further comprise a transparent, translucent or opaque film, which may comprise graphics on the film.

A primary object of the present invention is to provide a removable and disposable chemiluminescent light source for various articles.

A primary advantage of the present invention is that it provides an illuminated article that is easy to laminate.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIGS. 1A–1D depict a lighter with a light chamber for insertion of a chemiluminescent tube or other lighting device;

FIGS. 5A–5D depict an illuminated flag embodiment having a rear light stick insertion compartment;

FIG. 16 depicts a shirt with a light stick inserted under the collar or on the cuff in a mesh pocket.

DESCRIPTION OF THE PREFERRED EMBODIMENTS

(BEST MODES FOR CARRYING OUT THE INVENTION)

The present invention relates to various products and novelty items using chemiluminescent lighting.

Turning now to the drawings, an illuminated lighter is shown in FIGS. A–1D. FIG. 1A is a side view, FIG. 1B is a front exploded view, FIG. 1C is a bottom view and FIG. 1D is a top view of the lighter. The lighter is preferably a butane or other type of fluid fuel. The lighter comprises a lighter body 10 having typical elements of a lighter, but comprising a light stick chamber 12 within lighter body 10 for inserting light stick 14 which is used for illuminating the lighter from within. Preferably, light stick chamber 12 is disposed within the normal dimensions of the lighter such that the volume of fluid fuel compartment 16 is slightly reduced. Such a chamber 12 is formed in the manufacturing process. However, light stick chamber 12 may comprise an additional length, width, and volume outside of the lighter body 10, such that the chamber protrudes from or enlarges the lighter body. When chamber 12 is disposed within lighter body 10, it is preferably positioned along a side or in a central position for better illumination of the lighter. Alternatively, the light stick chamber may be manufactured separately from the lighter body and applied thereafter with application means known in the art, such as but not limited to adhesives, laminations, screws and the like.

In the preferred embodiment, light stick chamber 12 has an open end from which light stick 14 protrudes slightly (e.g., 3⁄16"), facilitating replacement. In alternate embodiments, the light stick chamber may comprise a cap or other closure on its open end and have an internal diameter greater than the external diameter of the light stick, thereby allowing easy, gravity-assisted removal of the light stick from the open light stick chamber. Light stick 14 preferably fits chamber 12 closely, but not too tightly.

In any of the lighter embodiments, the material of lighter body 10, or at least light stick chamber 12, is at least partially translucent, or transparent or opaque. Opaque or translucent screened designs or decorations may be applied to the lighter body or the light stick chamber.

Figure 2B:
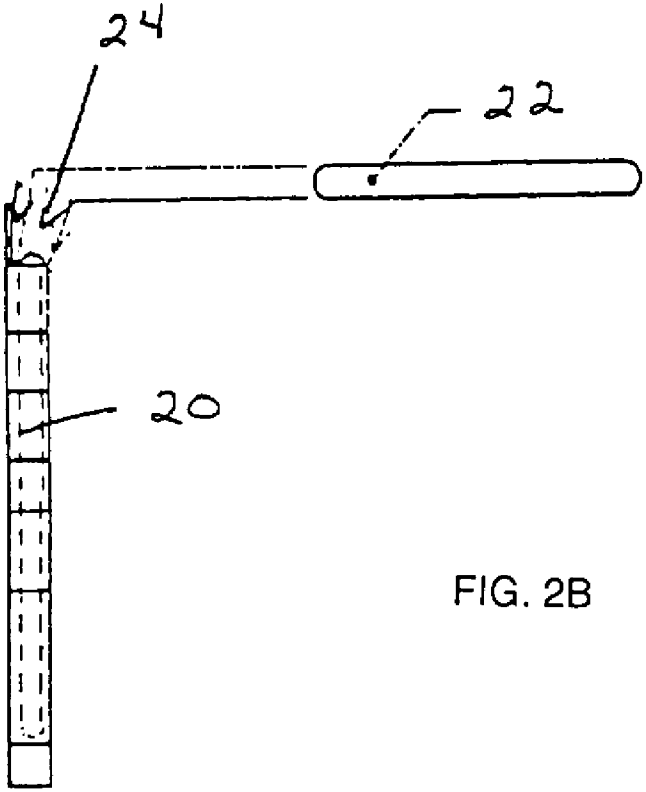
FIGS. 2A and B depict illuminated tree ornament having an insertion area for a chemiluminescent light stick.
Figure 2A:
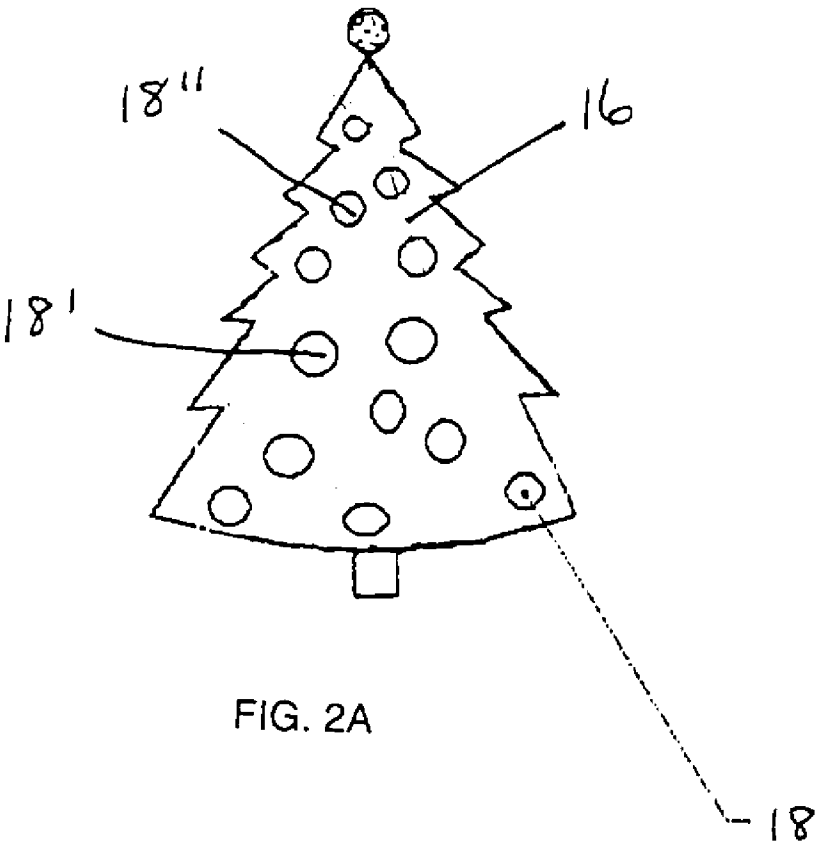

FIGS. 2A–B depict an illuminated tree ornament. FIG. 2A is a front view and FIG. 2B is an exploded side view of the ornament. The ornament comprises translucent, transparent or opaque tree-shaped body 16, comprising additional translucent decoration areas 18, 18', 18", etc. Body 16 preferably has light stick chamber 20 disposed on its back surface. Light stick 22 is insertable and removable in chamber 20. Such chamber 20 preferably comprise insert opening 24 within body 16 of the ornament.

The tree ornament may be of any size for use as earrings, pendant, beads, window decoration, fob, hanging ornament, table decoration, and the like. The tree may be opaque with clear or translucent ornaments and lights to be back-lit, or the entire tree may glow. Decorations on the tree may be of any translucent or transparent material (e.g., glass, plastic, ceramic, or stone). The tree may be wood or metal with the decorations applied or made of translucent or transparent materials with coloring applied, or any combination of materials and coloring.

Figure 3A:
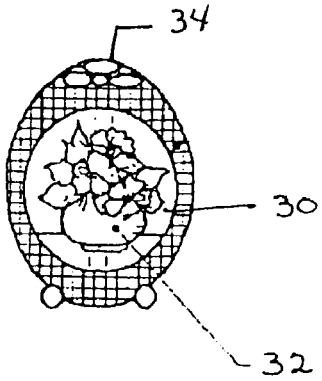
FIGS. 3A–3E depict illuminated egg-shaped embodiments with an interior light stick insertion chamber.
Figure 3B:
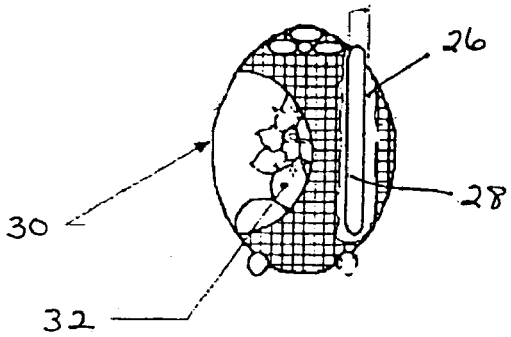
Figure 3C:
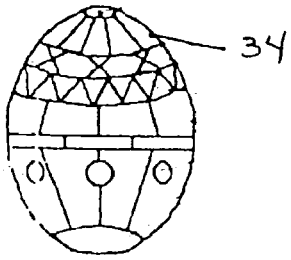
Figure 3D:
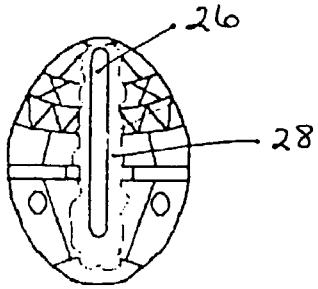
Figure 3E:
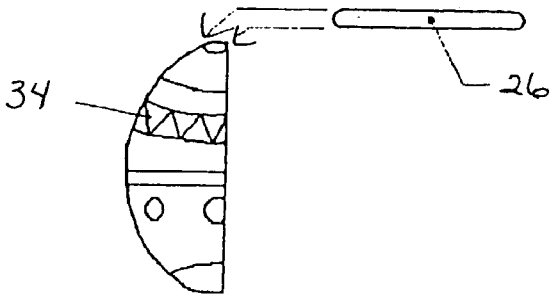

FIGS. 3A–3E depict an illuminated egg ornament. FIGS. 3A and 3B are front and side views of a decorated egg with an optional window. FIGS. 3C and 3D are front and side views of an egg with faceted and/or cabochon gems, possibly including enamel work. FIG. 3E is a half egg embodiment. Such eggs may be real or may be ornamental eggs. The egg ornaments may comprise synthetic or natural gems 34 (which are translucent, transparent or opaque) completely or partially covering the outside of the egg. Light stick chamber 26 contains removably disposable light stick 38. Light stick chamber 26 is located at the center, or near the center, of the egg. In flat-backed or half egg (FIG. 3E), light stick chamber 26 is disposed near or at the back of the ornament. The egg is made in a half round to be back-mounted or use as a pin, bolo slide, brooch, and the like.

The eggs may be of any size for use as earrings, pendants, beads, window decorations, fobs, hanging ornaments or table decorations. FIGS. 3A and B embodiments may have a sculpture or other pattern inside 32 to be back-lit, such as trade logos, sport logos, pictures, advertising, seasonal images, and the like. Gems on the eggs may be of any translucent transparent or opaque material, e.g., glass, plastic, ceramic, or the like. The eggs may have enamel work or other decorative work applied to accent the "gems". The eggs may have feet or may sit in a holder. The base may be of any shape such as square, diamond, circle, triangle, or polyhedron. The eggs may have a wood shell or metal frame with the "gems" inset, or the eggs may be made of one piece of translucent, transparent or opaque material. The eggs may be of any size for use as earrings, pendants, beads, window decorations, fobs, hanging ornaments or table decorations.

Figure 4C:
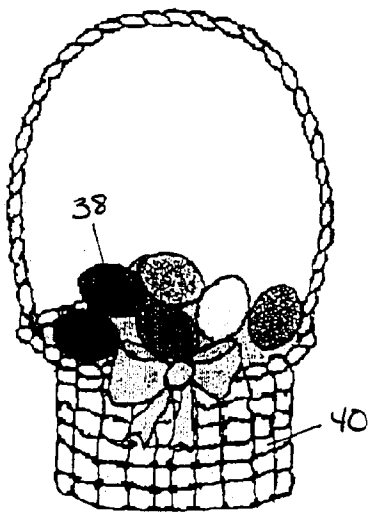
FIGS. 4A–4C depict an illuminated Easter basket embodiment with decorative eggs and a rear light stick chamber.
Figure 4B:
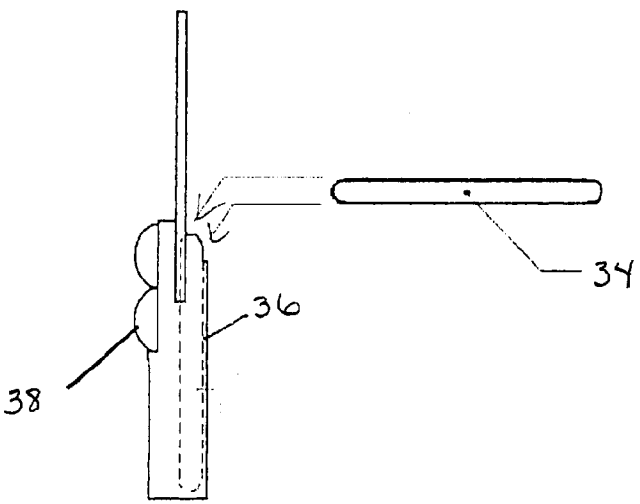
Figure 4A:
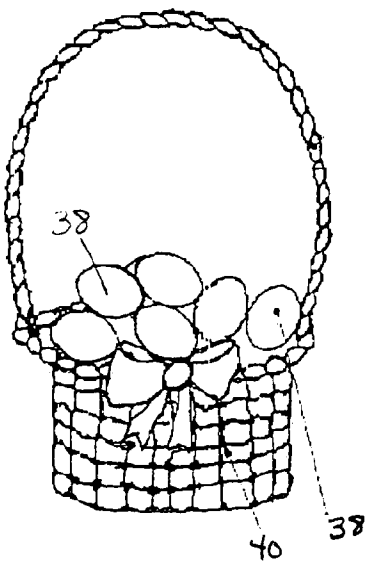

FIGS. 4A–4C depict an Easter basket embodiment. FIG. 4A is a front view and 4B is a side view of the Easter basket. FIG. 4C shows the illuminated Easter basket (front view). As shown therein, light stick 34 is removably insertable and removable into chamber 36 disposed behind "eggs" 38. Eggs 38 and optionally basket 40 are lighted when light stick 34 is activated.

The basket may be of any size for use as earrings, pendants, charms, window decorations, fobs, hanging ornaments, table decorations, bolo slides, pins, and the like. The basket may be made of metal set with "gem" eggs of any translucent, transparent or opaque material such as basket glass, plastic, ceramic, or stone, or the item may be made all of one piece or translucent, transparent or opaque material. When the basket is not mounted as a pin, wall ornament or similar application, both sides may have the design applied with the light stick in between. The basket may be plain or have a woven pattern. The woven pattern may or may not have slots, through which the light stick can be seen. The light stick may be inserted into a drilled hole when material such as Lucite or stone is used, or may have guide ridges when an open construction is used in manufacture.

The light stick may be inserted into a drilled hole when material such as Lucite or stone is used, or may have guide ridges when an open construction is used in manufacture.

FIGS. 5A–D depict a flag embodiment of the present invention. FIG. 5A is a front view, FIG. 5B is a side view, FIG. 5C is a back exploded view and FIG. 5D is an alternative view. Light stick 42 is removably insertable into chamber 44 behind flag 46 Chamber 44 may be horizontal (see FIG. 5C) or vertical (see FIG. 5D) or at an angle (not shown). The flag may be of any size for use as earrings, pendants, beads, window decorations, fobs, hanging ornaments, table decorations, bolo slides, pins and the like. The flag may be made of metal set with "gems" of any translucent, transparent or opaque material such as glass, plastic, ceramic, or stone, or the flag may be made all of one piece of translucent, transparent or opaque material. When the flag is not back mounted, both surfaces may have the same design, mirrored. The flag may be waving or straight and may or may not have a flag pole.

Light stick 42 may be inserted into a drilled hole when material such as Lucite or stone is used, or may have guide ridges when an open construction is used in manufacture.

Figure 6A:
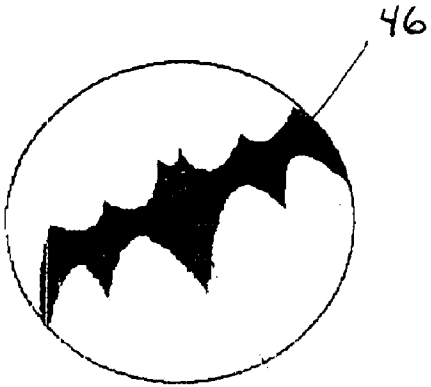
FIGS. 6A–6B depict an illuminated back-lit decoration, for example, with seasonal silhouettes.
Figure 6B:
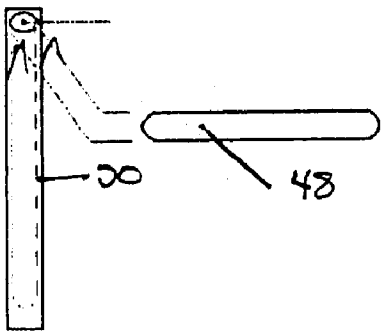

FIGS. 6A–B depict illuminated decorations. FIG. 6A is a front view and FIG. 6B is a side view of the illuminated decoration. An opaque or translucent silhouette 46 is positioned in front of light stick 48. Preferably, the decoration comprises translucent light stick chamber 50 for holding slight stick 48. The example depicted includes a seasonal decoration (a bat for Halloween), but any silhouette or reverse silhouette designs may be utilized.

The item may be of any size for use as earrings, pendants, beads, window decorations, fobs, hanging ornaments, table decorations or the like. The face(s) may have a silhouette or other pattern applied to be back-lit such as trade logos, sport logos, pictures, advertising seasonal images, and the like. Face areas of the item may be of any translucent, transparent or opaque material, e.g., glass, plastic, ceramic, stone or the like. When the item is not back mounted, both surfaces may have the same or different designs. The item may have a wood shell or metal bezel or the item may be made all of one piece of translucent, transparent or opaque material. The item may be made in any shape such as square, diamond, circle, triangle, polyhedron, and the like. Silhouettes may be of metal, ink, or other opaque material and may have cut-outs, inlaid "stones", or other decorative work.

Figure 7B:
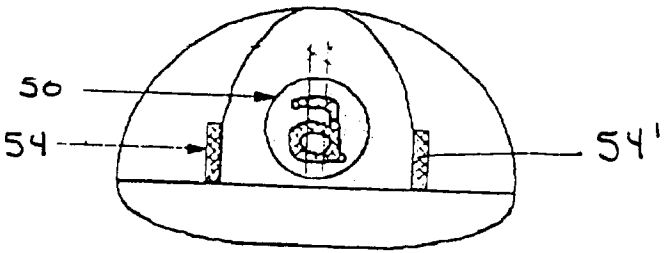
FIGS. 7A–7B depict a baseball cap having a translucent or partially opaque design illuminated with a light stick, and having spare light stock pockets.
Figure 7A:
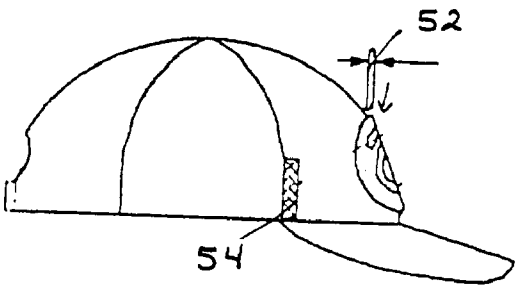

FIGS. 7A–B depict baseball cap embodiments. FIG. 7A is a side view and FIG. 7B is a front view of the baseball cap. This invention may be utilized on any hat, jacket, or other article of clothing or accessory. This embodiment comprises a translucent, partially translucent, translucent or opaque flat or three-dimensional design element 50 disposed on a hat, preferably by stitching or adhesive. Preferably, one or more activated light sticks 52 are inserted into a space, opening, or chamber positioned behind design element 50, causing light stick 52 and design 50 to luminescence. In the preferred embodiment, additional "pockets" or holders are disposed on the hat or other article for containment of additional, unactivated light sticks, 54, 54' until use is desired. On all such accessories, more than one design element may be utilized. Further, the design may comprise a translucent background and an opaque silhouette, a transparent design and an opaque background, or a completely transparent design.

The cap (e.g. baseball cap) cap may be of fixed or variable size. The spare light stick pockets should be made of a stretchable fabric stitched into the seams of the baseball cap. Decoration 50 may have a silhouette or other pattern applied to be back-lit, such as trade logos, sport logos, pictures, advertising, seasonal images or the like. Decoration 50 may be of any washable translucent or transparent material such as plastic or a suitable cloth. Decoration 50 should be either stitched on or applied with a suitable wash resistant adhesive.

Figure 8A:
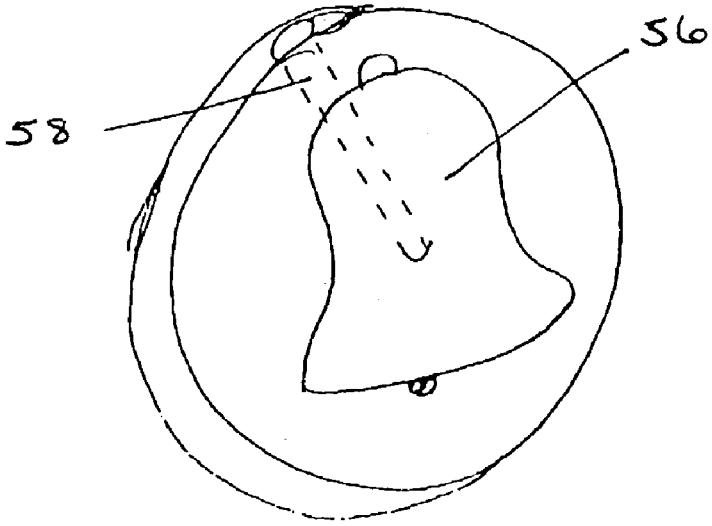
FIGS. 8A–8B depict pins that are in a holiday or theme shape which are illuminated with a light stick inserted behind to light up the pin.
Figure 8B:
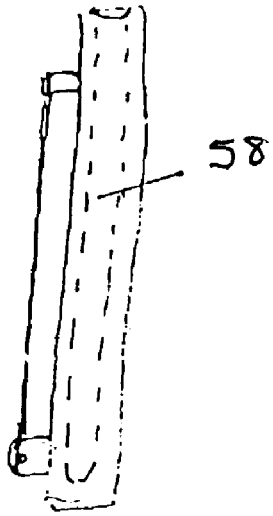

FIGS. 8A and 8B show a pin embodiment. FIG. 8A is a front view and FIG. 8B is a side view of the pin. The pin may be made of metal, molded glass, paper, plastic or the like. The front of the pin preferably features holiday themes or is shaped in a pattern 56 to represent a holiday, such as Christmas. Pattern 56 can also be used for advertising pins or as identification badges. Potential uses are as promotional pins for sports teams or political candidates. The pin also may be modified for use as a pendant, charm, earring or keychain. Light stick 58 is removably inserted behind the pin's pattern 56 which causes the pattern to "light up."

The holiday or birthday pin may be made of molded glass, paper or plastic, with a box pin back with the holiday or other design on the front. Pins can also be square or shaped to a pattern; e.g., tree, bell, Santa, birthday cake, or the like. The pin may be stamped or molded to shape, machined. The pin may have punched "cut-outs."

Figure 9:
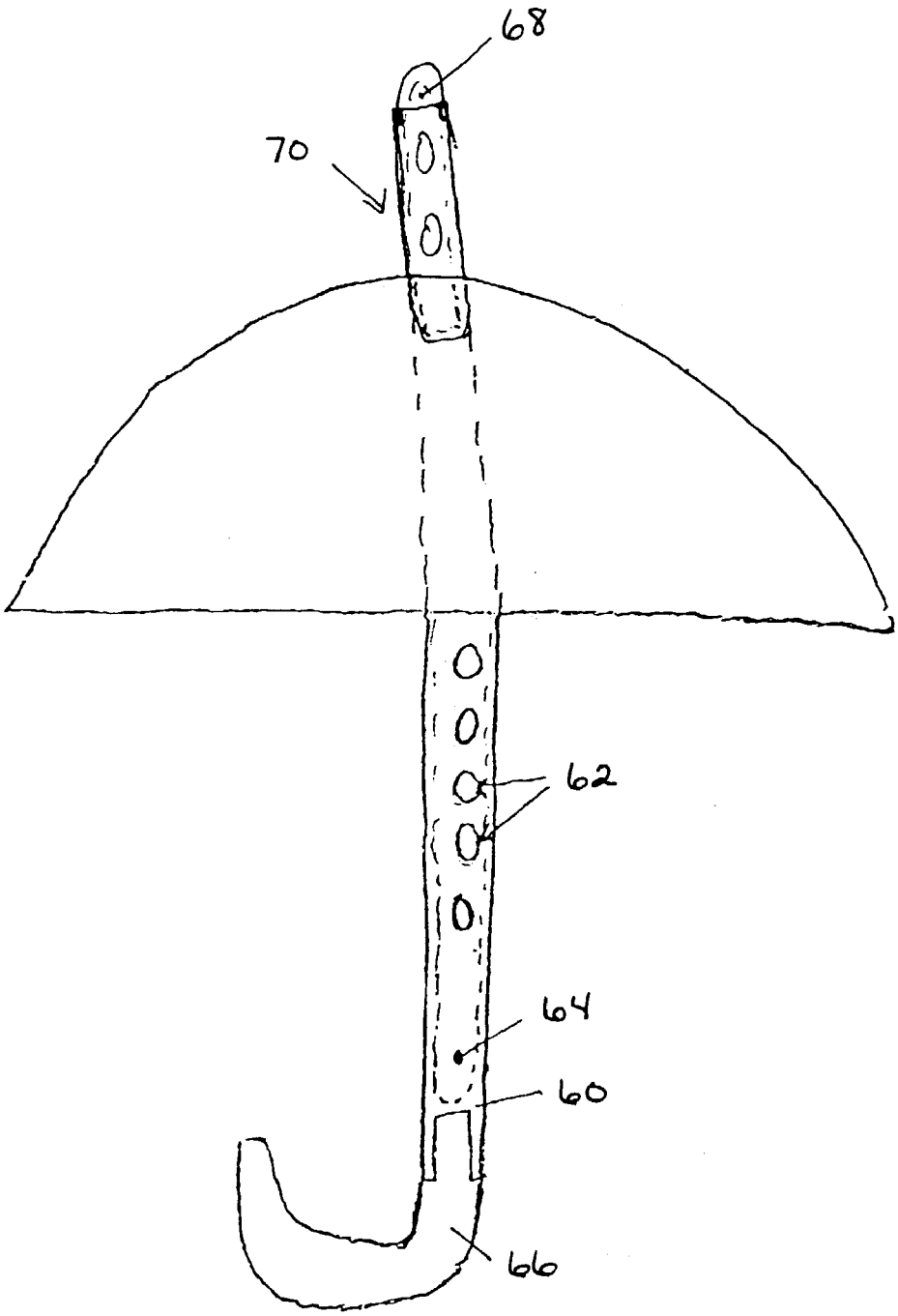
FIG. 9 depicts an umbrella with a handle in which light sticks have been inserted for illumination.

FIG. 9 shows an umbrella with tube 60 that is made from clear material or which has been decorated with cutouts 62. Light stick 64 is placed inside handle 60 by removing detachable bottom. 66 Detachable handle 66 may be attached and detached from tube 60 by twisting, threads, pull-out mechanism, and the like. Light stick 68 can also be placed inside 70 at the top of the umbrella.

Umbrella tube 60 may be clear or opaque with cutouts 62. Clear or opaque hard plastic tube 60 may be colored, patterned, or decorated in any manner that won't interfere with operation of the umbrella. An opaque tube 60 with cutouts 62 may have inset "gems" or a film covering. It also may be made of plastic or metal.

Figure 10:
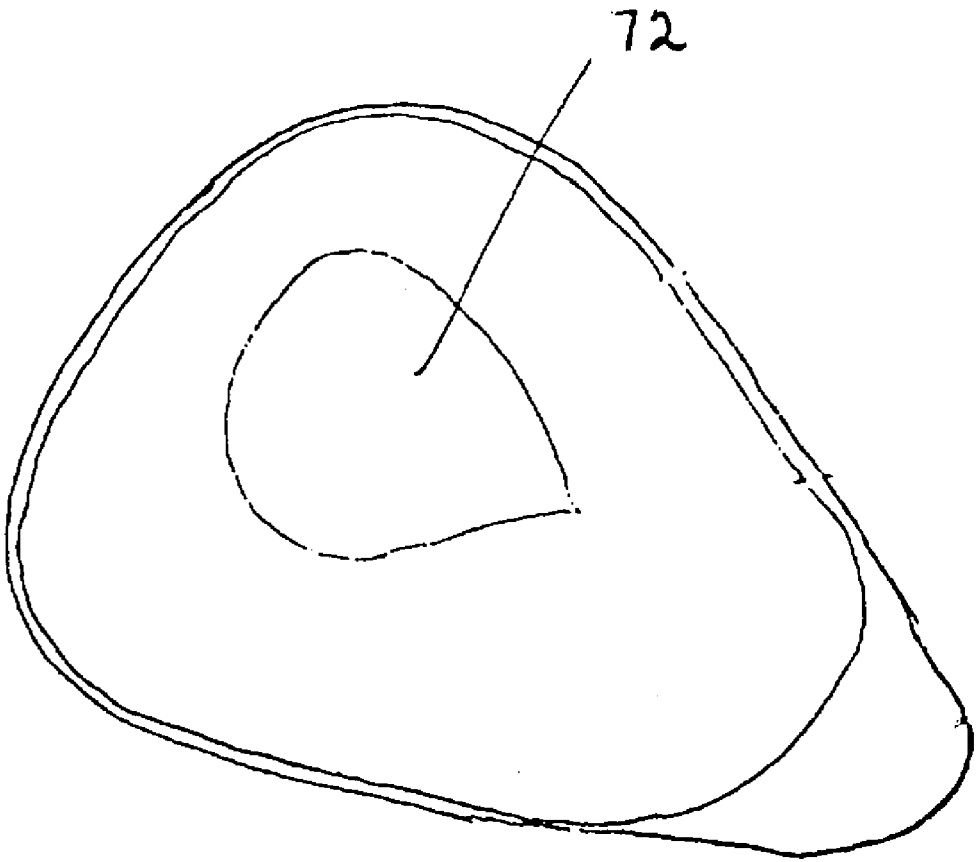
FIG. 10 depicts a guitar pick surrounded by a chemiluminescent fluid or pocket.

FIG. 10 shows a light stick guitar pick. As shown therein, capsule 72 inside the pick is surrounded by a chemiluminescent fluid or pocket 74. Capsule 72 activates chemiluminescent fluid 74 causing the guitar pick to glow.

Figure 11:
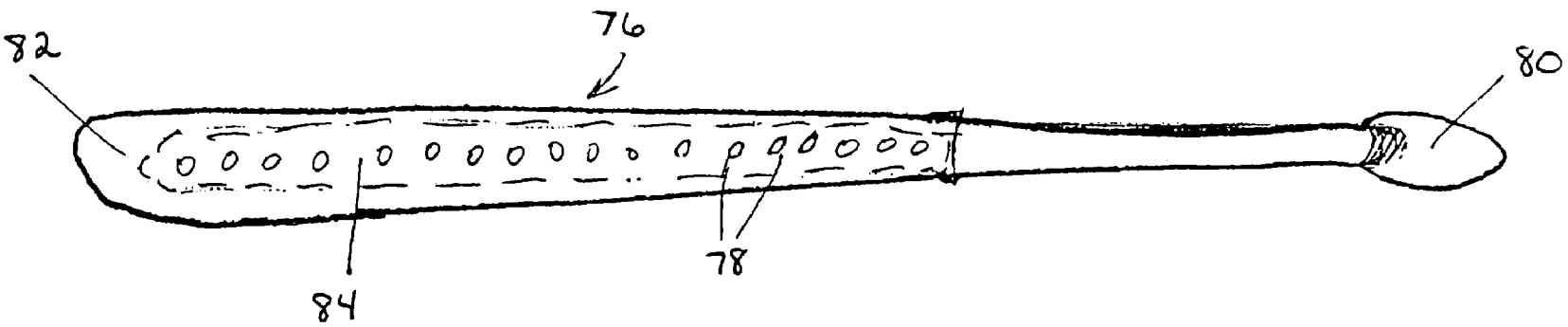
FIG. 11 depicts a drumstick with a grip containing cutouts.

FIG. 11 shows a drumstick with grip 76. Grip 76 has cutouts 78, (e.g, various shapes). Light stick 84 can be inserted in tip 80 or end 82 of the drumstick. Preferably, light stick is long (e.g. 10"). In one embodiment, by unscrewing a tip, light stick 84 is inserted into the drumstick through tip end 80.

Figure 12:
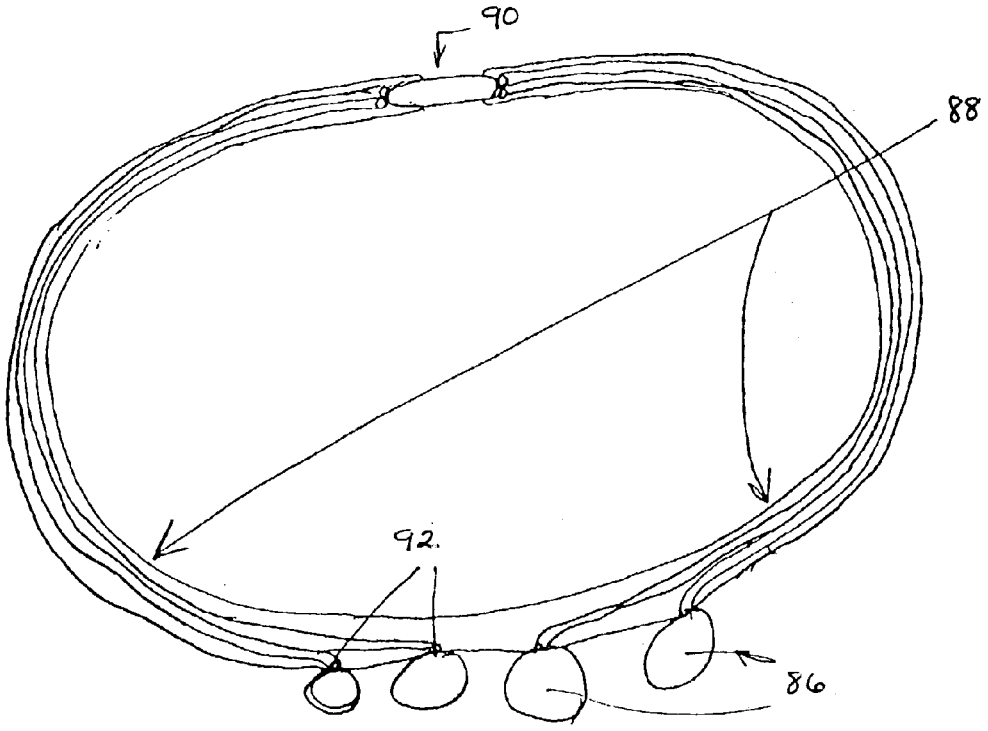
FIG. 12 depicts a bracelet or necklace in which fiber optic strands or bundles are lighted by a chemiluminescent light stick.

FIG. 12 is a bracelet or necklace embodiment with lighted gems 86, which can be faceted, smooth, colored, or clear (e.g., made of glass, plastic or stone). Fiber optics strands or bundles are lighted by the chemiluminescent light stick 90. Ends 92 of fiber optics strands 88 terminate to gems 86, using light stick 90 for illumination. Gems 86 may be colored and use a "white" light stick 90, or gems 86 may be clear but illuminate with the color of a colored light stick 90.

Figure 13B:
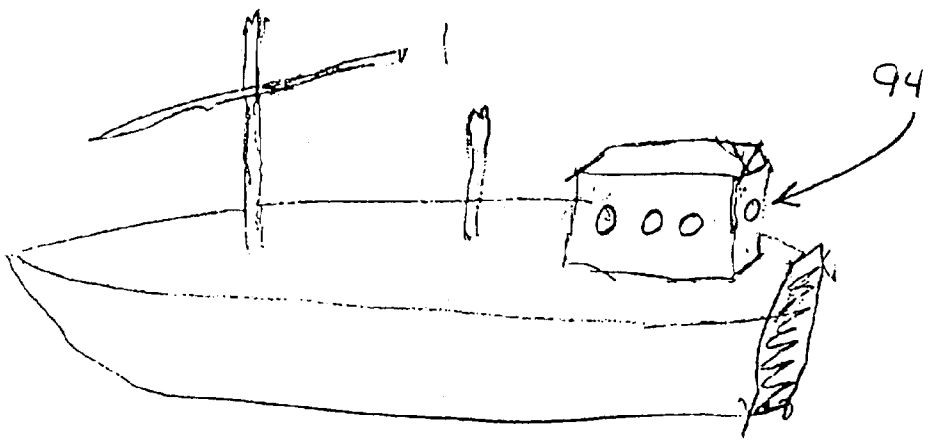
FIGS. 13A–13B depict an aquarium figure with a light stick inserted inside.
Figure 13A:
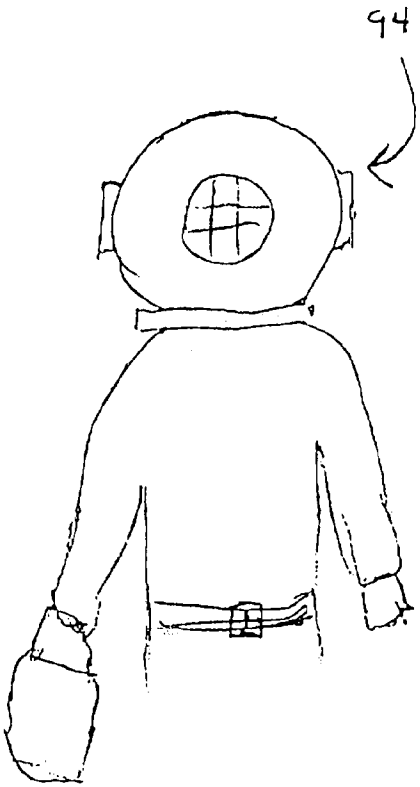

FIG. 13 depicts figures which are placed inside aquariums. Removable light sticks 94 are inserted inside these figures to illuminate the figures.

Figure 14:
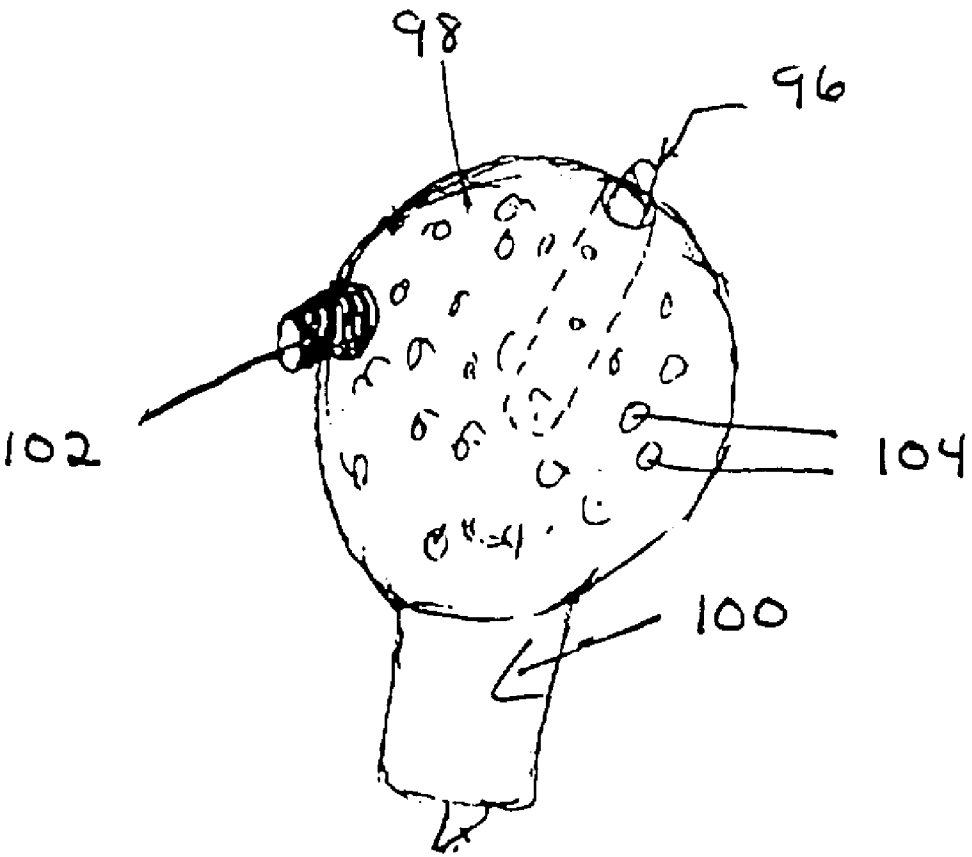
FIG. 14 depicts a liquid dispenser top with a light stick inserted.

FIG. 14 is a translucent or clear plastic liquid dispenser top. Light stick 96 is placed inside top 98 which has a cork (or other bottle-fitting material) bottom 100. It is then inserted into a bottle.

Figure 15B:
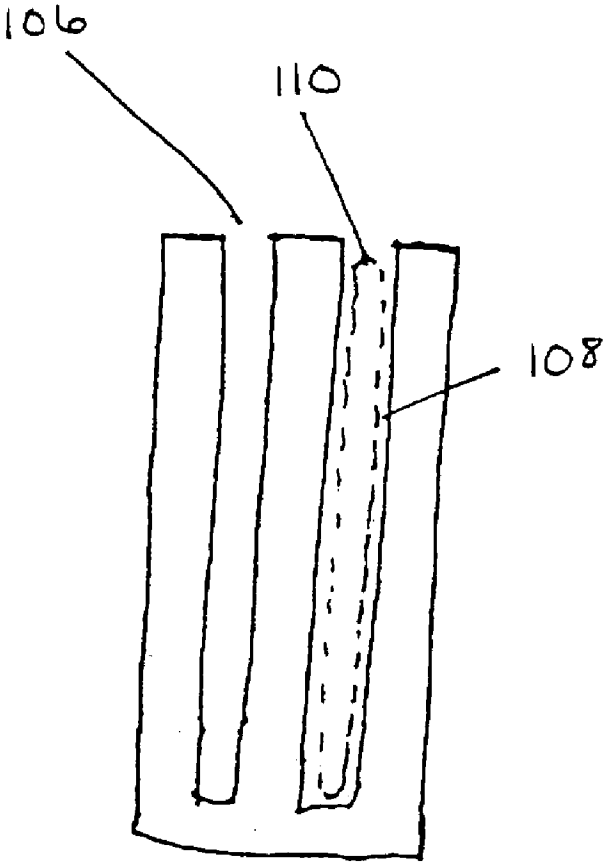
FIGS. 15A–15B depict a light stick slide viewer with a back slot for inserting a light stick for illumination.
Figure 15A:
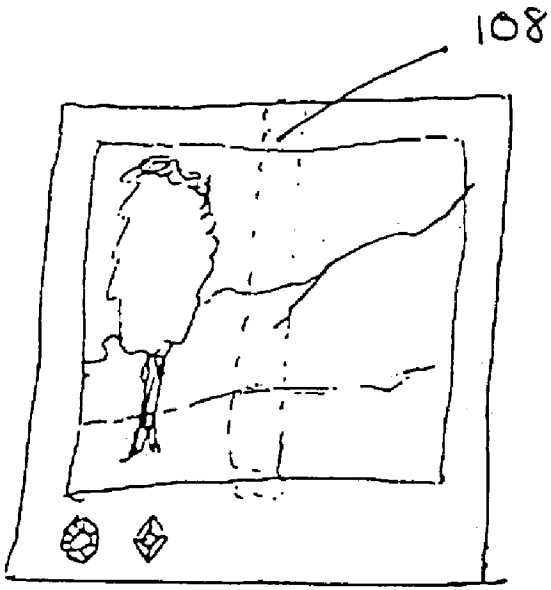

FIG. 15 shows a plastic light stick slide viewer. FIG. 15A is a front view and FIG. 15B is a side view of slide viewer. The slide viewer may be also in pin, table ornament, or pendant (e.g., made of a stone, plastic or glass decoration. Front slot 106 is an opening for a slide or other decoration. Back slot 108 is an opening for light stick 110 which provides illumination for the slide.

FIG. 16 shows a shirt which has light stick 112 inserted under the collar of the shirt and held in place by a mesh pocket. A mesh pocket as a light stick holder 114 can also be attached to the cuff of a shirt. The light enhances the shirt. If a necklace is worn it results in a glowing collar (e.g., pearls, iridescent beads, etc.)

Figure 17:
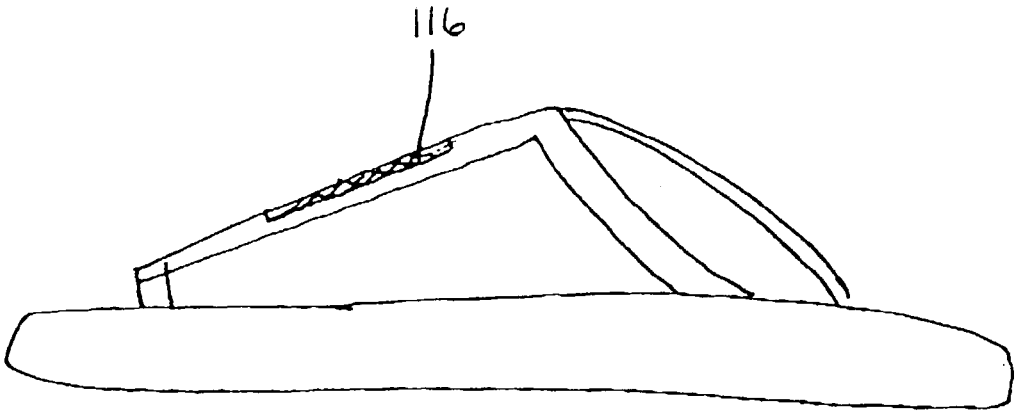
FIG. 17 depicts a sandal with a light stick inserted into a clear or mesh pocket attached to the sandal.

FIG. 17 depicts light stick 116 attached to a sandal with a clear or colored transparent window (e.g., nylon material). A mesh or clear pocket holds light stick 116 therein. Likewise, light sticks may be disposed in shoes and in other parts of the shoes (e.g., a heel).

Figure 18:
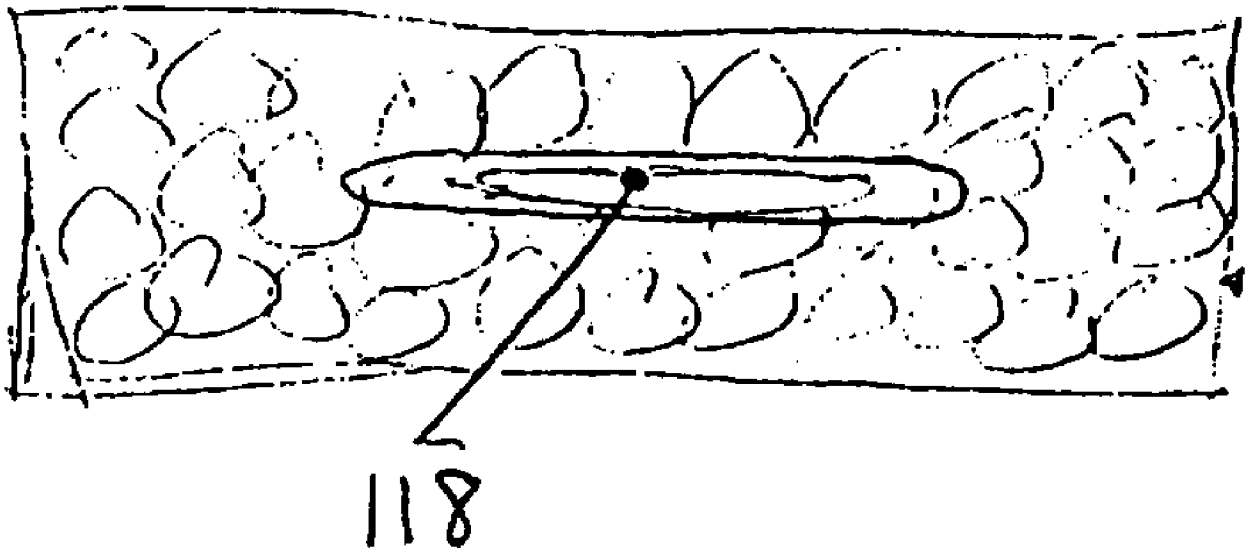
FIG. 18 depicts a light stick attached to a candy bar wrapped in paper with a hologram or shimmer film.

FIG. 18 depicts a light stick 118 disposed on a candy bar which is wrapped in paper with a hologram or shimmer film on the outside that is thereby illuminated by light stick 118.

Figure 19:
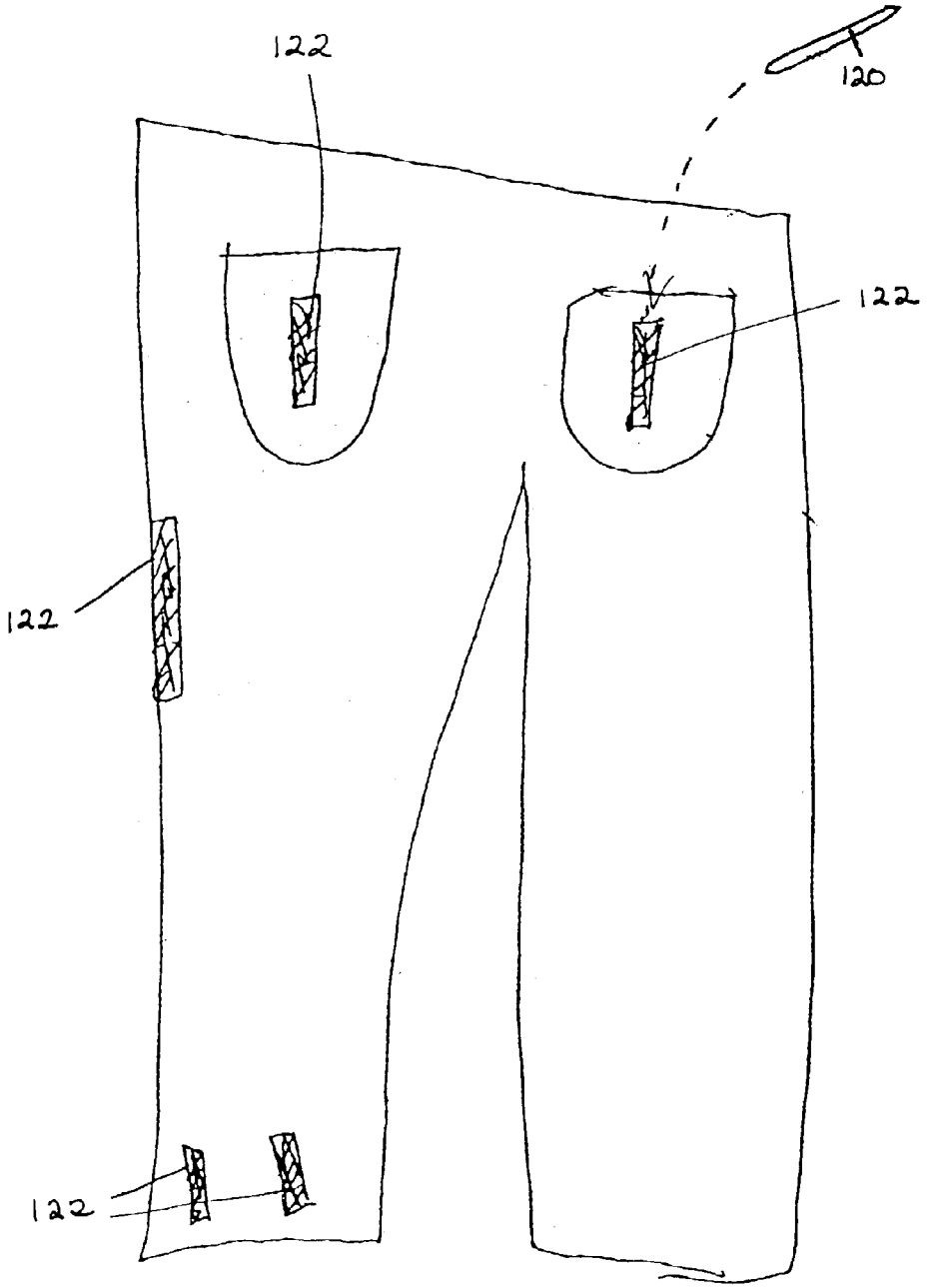
FIG. 19 depicts pants to which a light stick has been attached with a mesh material.

FIG. 19 depicts a pair of pants to which mesh material 122 has been attached for holding light stick 120. Light sticks are placed into the mesh to create different visual effects (e.g., on pockets, cuffs, sides, etc.)

Figure 20:
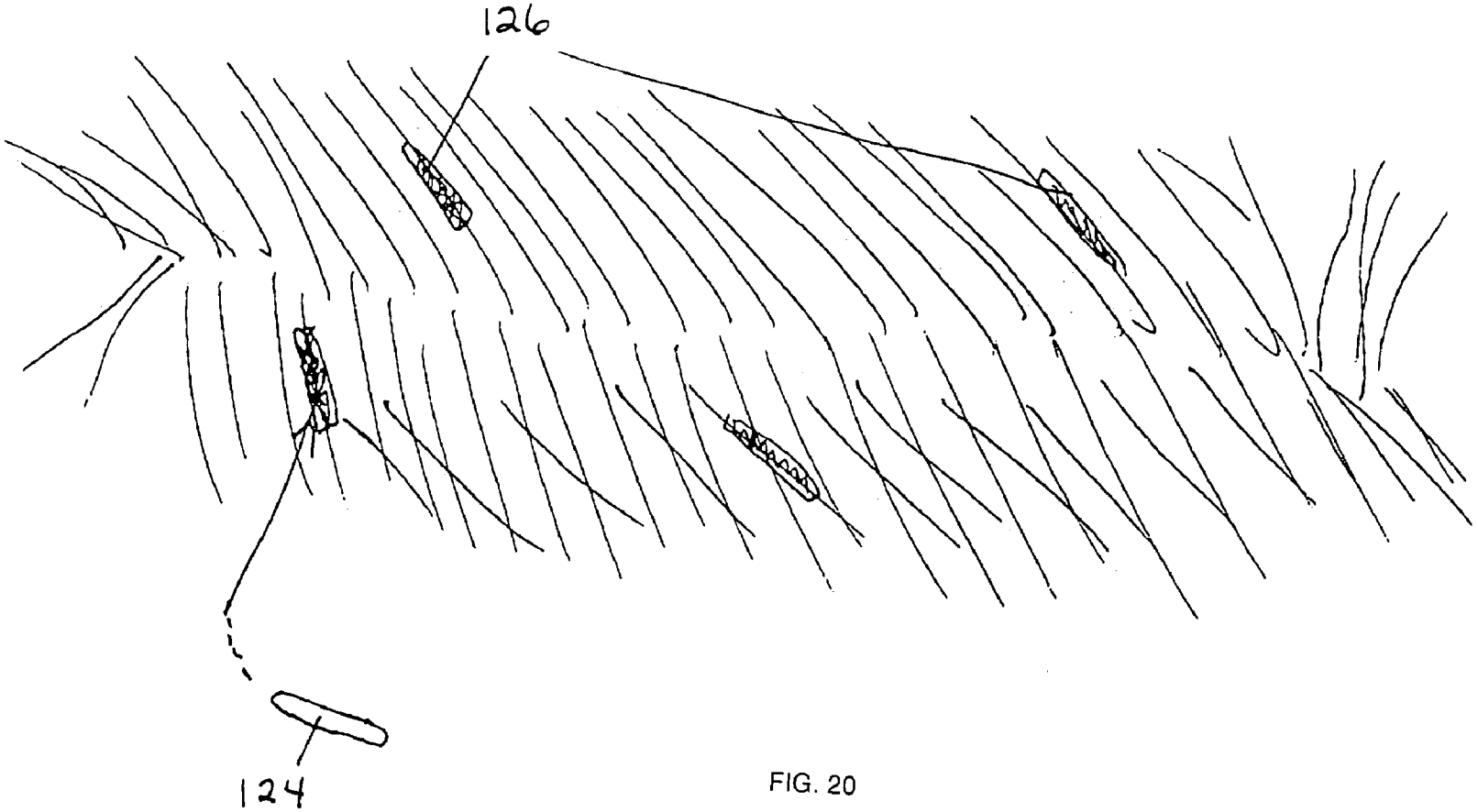
FIG. 20 depicts a scarf or boa with light sticks attached.

FIG. 20 depicts a scarf or boa which has been decorated with light sticks 124. The light stick holders are made of clear or mesh material 126 and attached to the scarf or boa.

Figure 21:
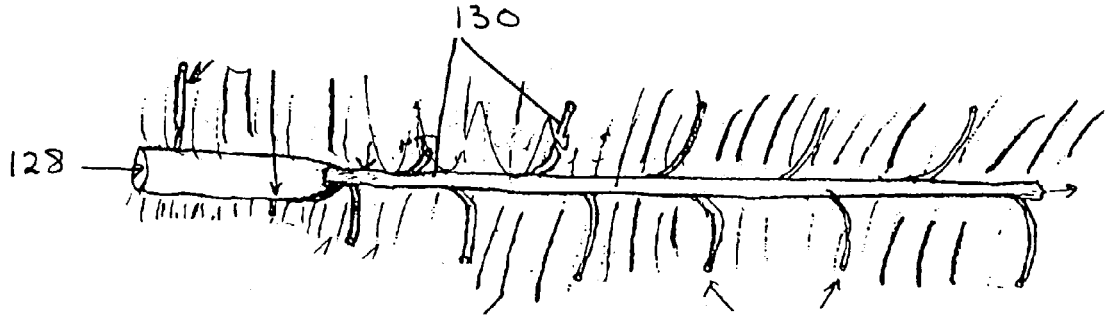
FIG. 21 depicts a scarf or boa with light sticks connected to fiber optics and attached to the scarf or boa.

FIG. 21 depicts a scarf or boa with light stick 128 connected to fiber optics 130. Fiber optics strands of a single color or various colors may be utilized.

Figure 22:
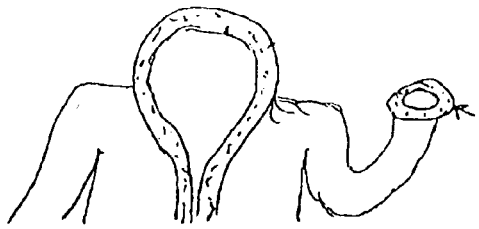
FIG. 22 depicts light sticks attached to collar or sleeve trims.

FIG. 22 depicts collar and sleeve trims using the embodiments of FIG. 20 or 21. Likewise the invention is also useful for hat and show trims.

Figure 23:
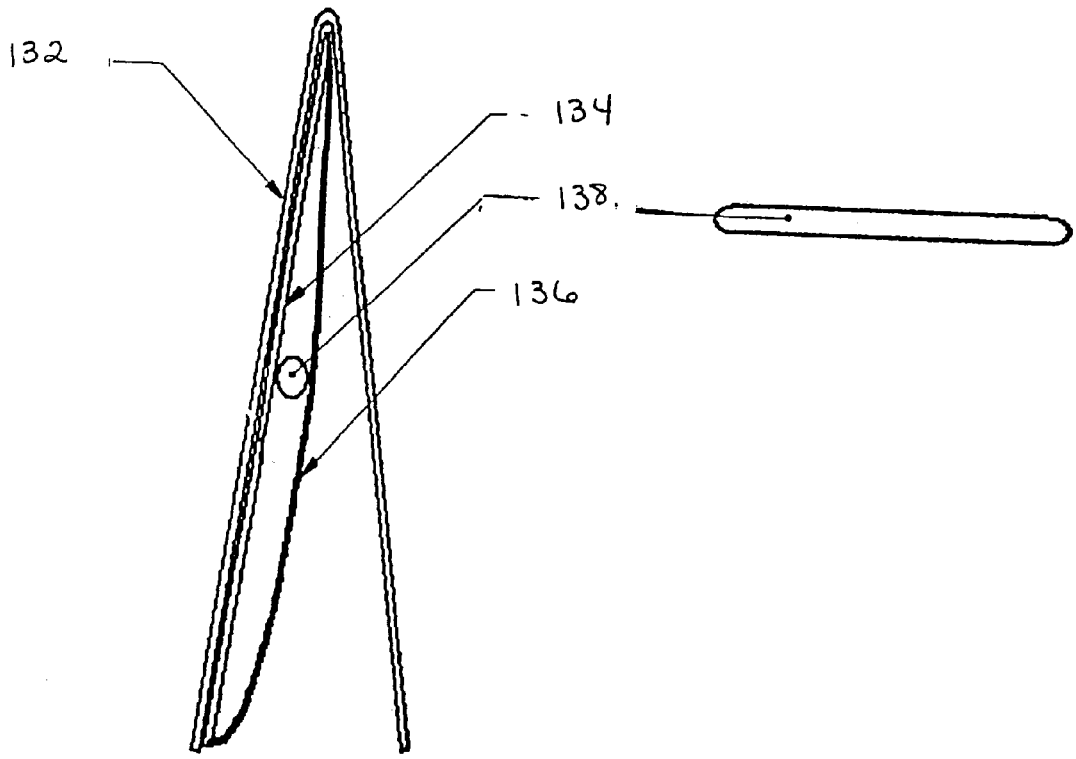
FIG. 23 is a side view of an illuminated greeting card.

FIG. 23 is a side view of the illuminated greeting card of the present invention.

Figure 24:
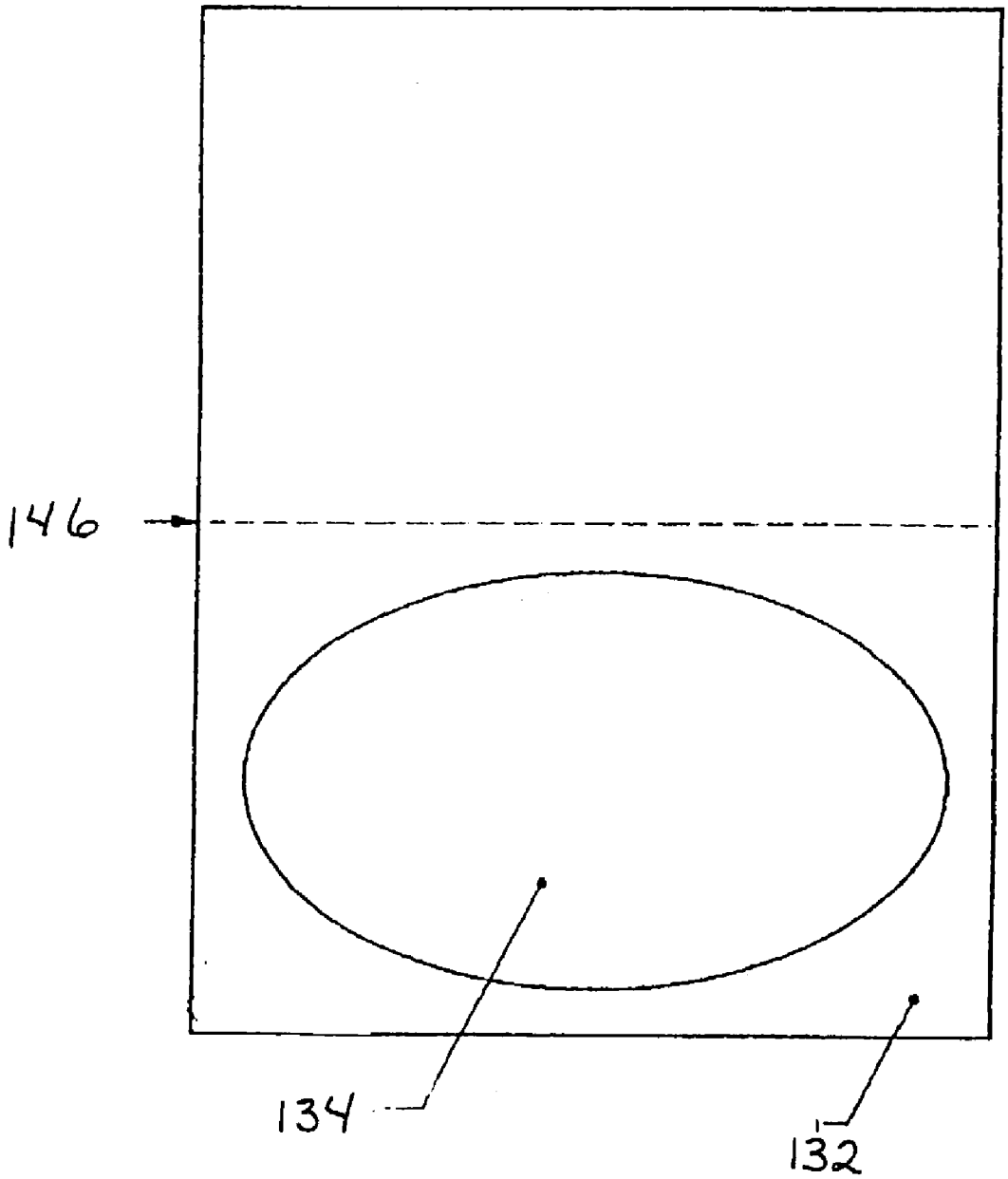
FIG. 24 is a front view of an illuminated greeting card.

FIG. 24 is a front view of the frame-type illuminated greeting card design of the present invention.

Figure 25:
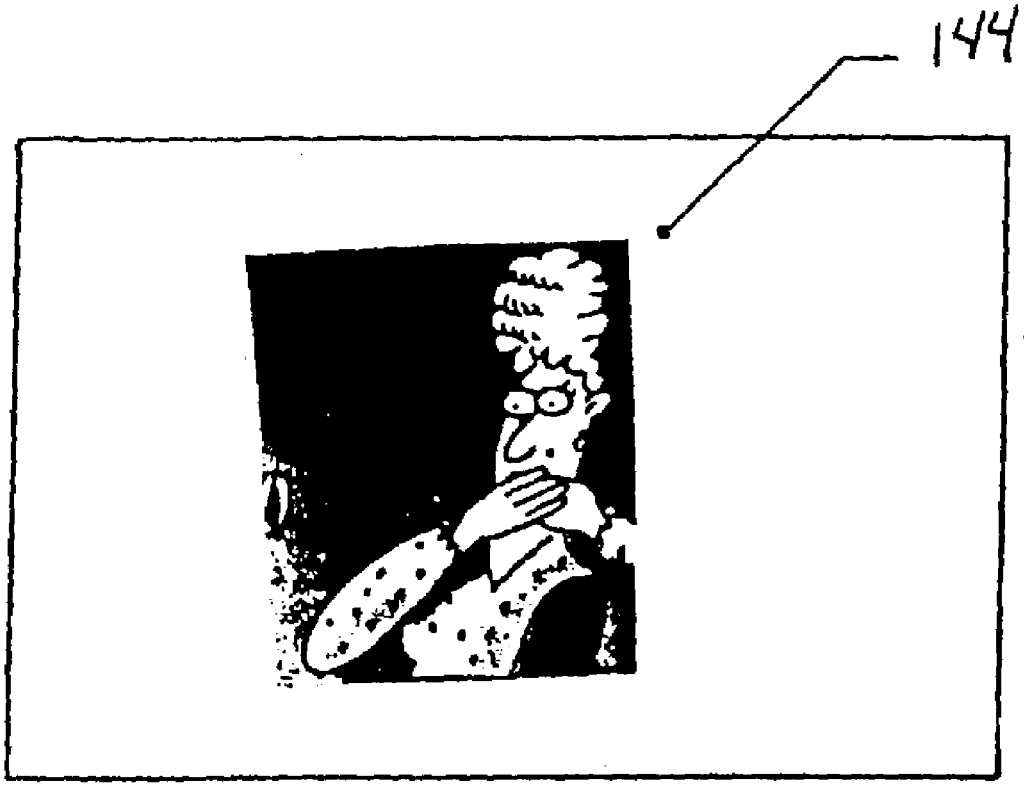
FIG. 25 is a front view of an illuminated greeting card with a cut-out.

FIG. 25 is a front unfolded view of the frame-type illuminated greeting card design of the present inventions showing a cut-out.

Figure 26:
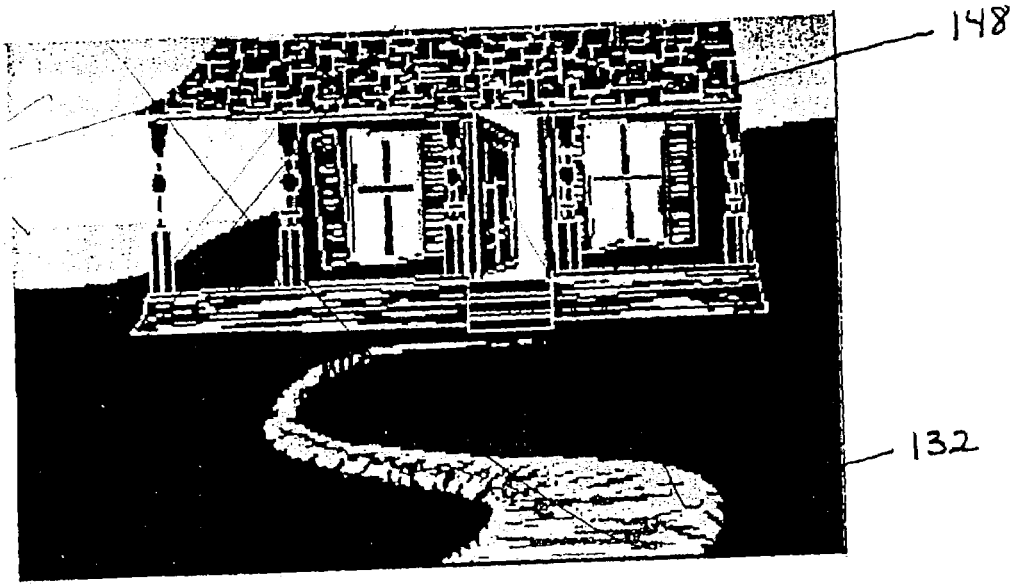
FIGS. 26 and 27 are front views of a frame-type illuminated greeting card.
Figure 27:
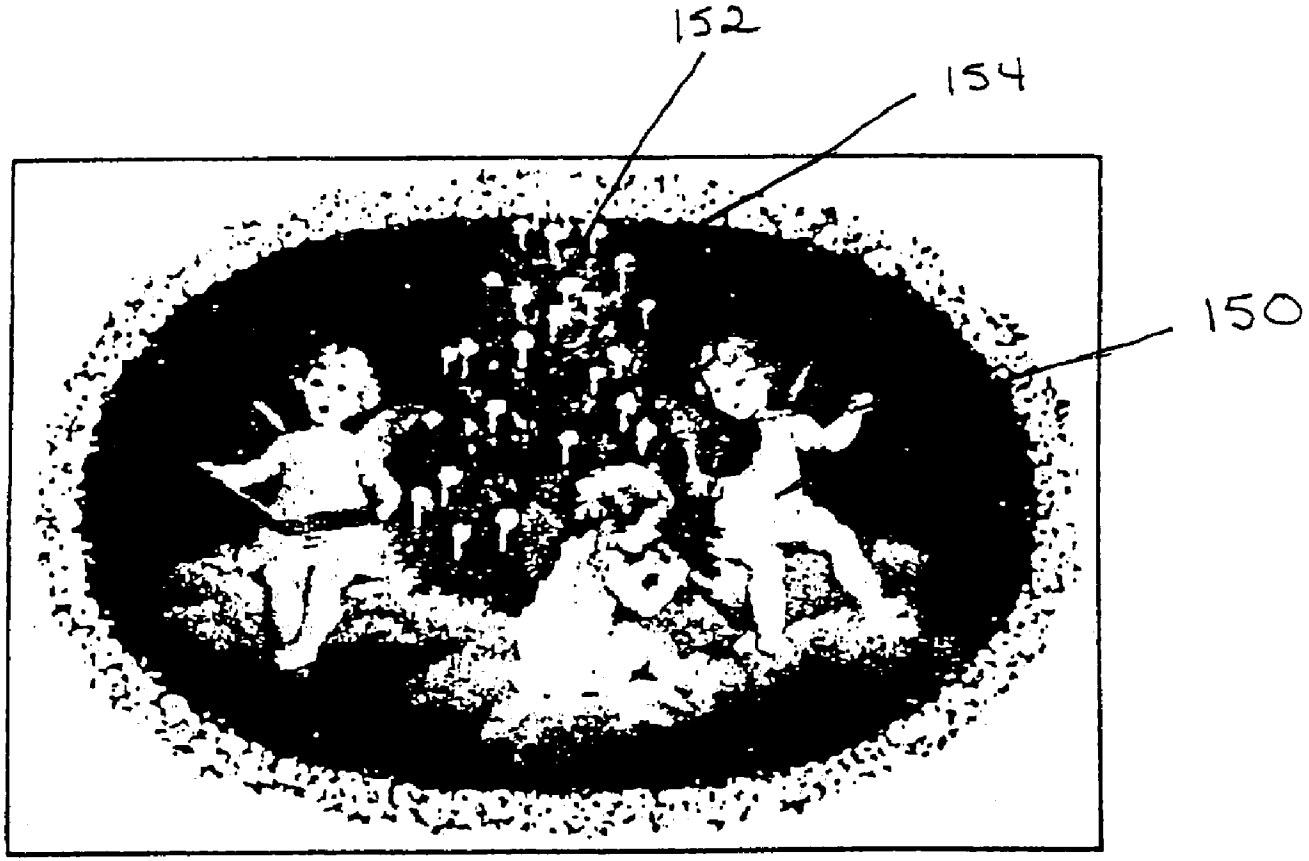

FIG. 25 is a front view of a graphic on a transparent or translucent film of the greeting card of the present invention;

FIGS. 26 and 27 are front views of a frame-type illuminated greeting card design of the present invention showing a graphic design on a transparent or translucent film.

Figure 28:
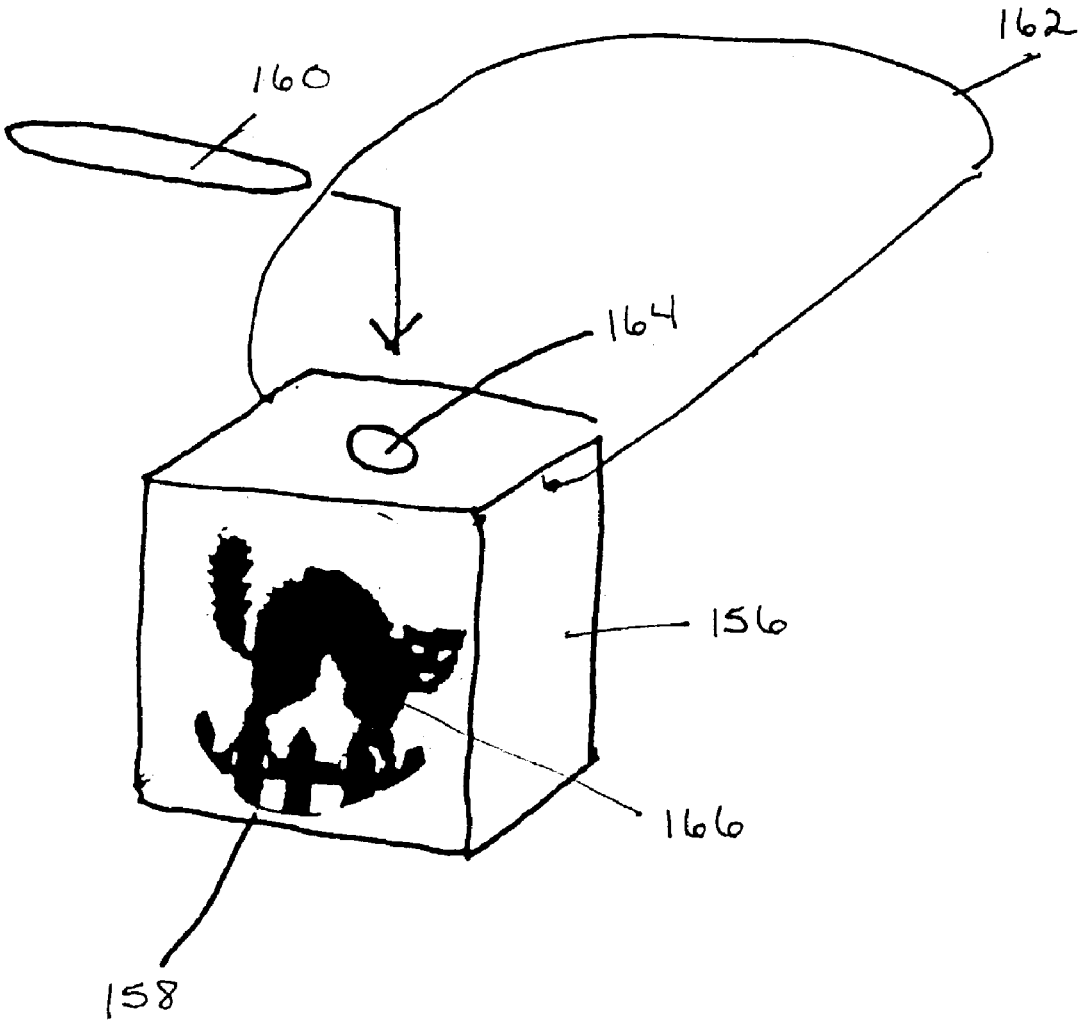
FIG. 28 is a perspective view of illuminated collapsible cardboard box-shaped disposable jewelry
Figure 29:
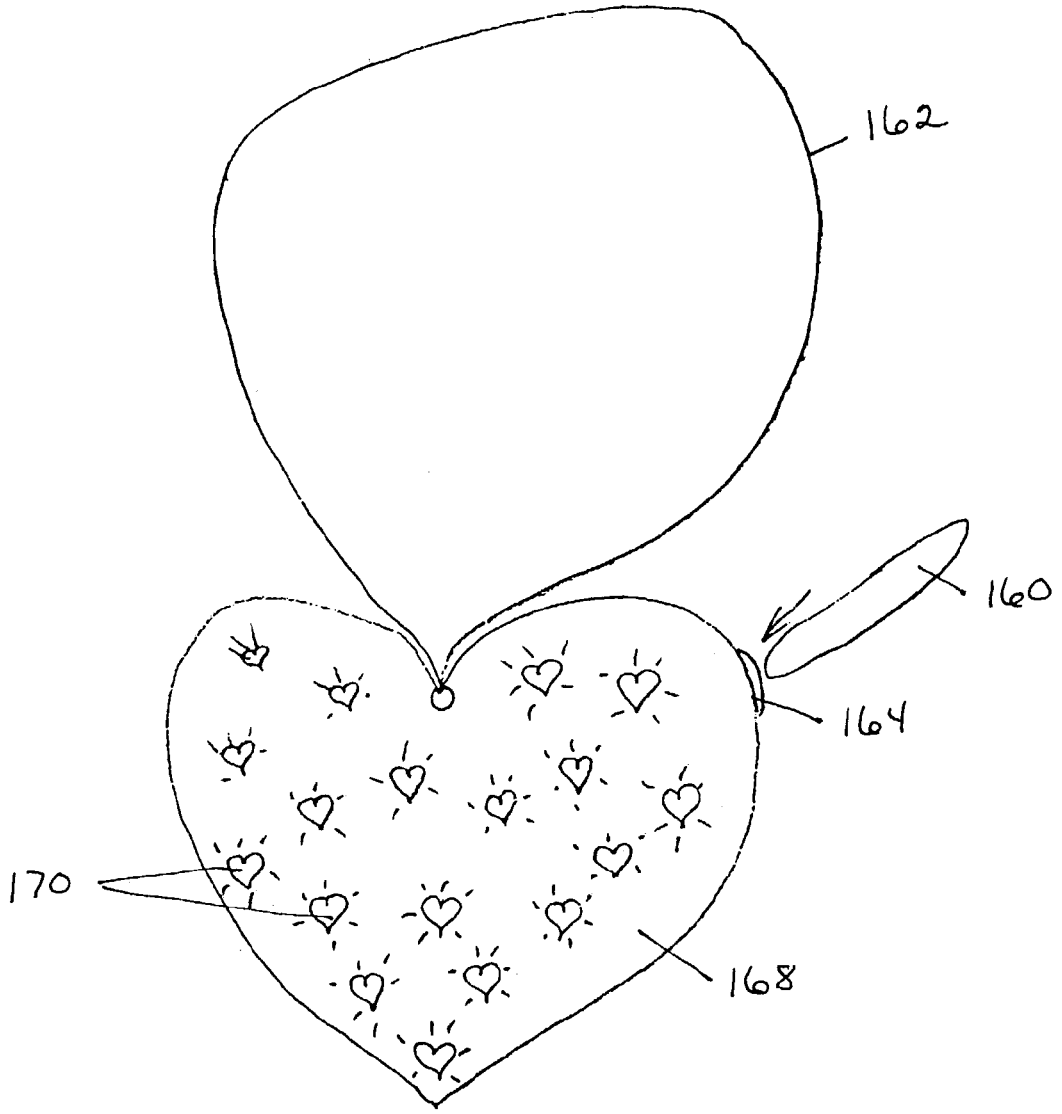
FIG. 29 is a front view of an illuminated collapsible cardboard disposable jewelry box.
Figure 30:
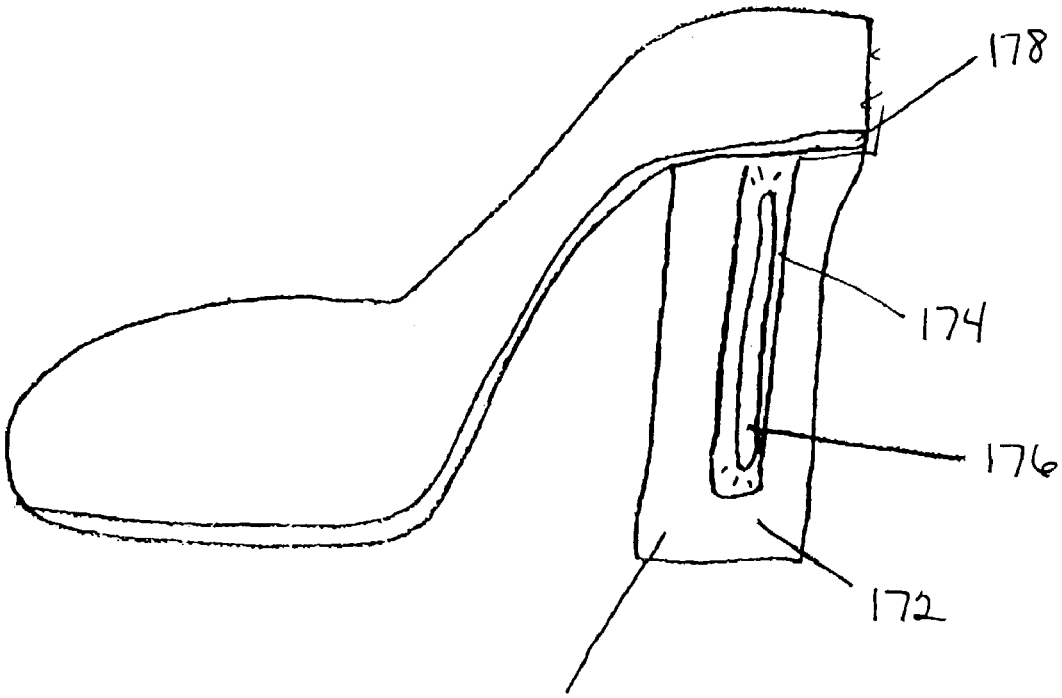
FIG. 30 is a side view of a shoe with a light stick inserted in the heel.

FIG. 28 is a perspective view of the illuminated collapsible cardboard box-shaped disposable jewelry of the present invention;

FIG. 29 is a front view of an illuminated collapsible cardboard heart-shaped disposable jewelry of the present invention; and FIG. 30 is a side view of a high heel show with a light stick inserted into the heel of the shoe.

The illuminated greeting card of the present invention, shown in FIG. 23, comprises a front page 132 (e.g., rigid card stock or the like), a backing or rigid card stock or the like, a transparent or translucent film 134, preferably with graphics, located behind front page 132 of the card, reflective film 136 located behind 134 transparent film 134 with a space 138 for inserting chemiluminescent light stick 140. The illuminated greeting card can be placed on a surface (e.g., a fireplace mantel) with the front 132 of the card facing the room and light stick 140 inserted behind transparent or translucent film 140 inserted behind transparent or translucent film 134 so that the illuminated card decorates the room, similar to other lighted holiday decorations.

As shown in FIG. 23, transparent or translucent film 134 attaches to the backside of front of the card 132 on all four sides. Transparent or translucent film 134 may be plain or decorated. Reflective film 136 attaches to transparent or translucent film 134 preferably on three sides with the reflective surface facing transparent or translucent film 134, forming a pocket 138 for holding light stick 140. Light stick 140 is inserted behind transparent or translucent film 134 so that it is sandwiched between this film 134 and reflective film 136. Reflective film 136 acts as a magnifier of the light emitted by light stick 140. In an alternate embodiment, the reflective film is adhered to the card stock backing of the greeting card, located behind the transparent or translucent film. In another alternate embodiment, the cardboard backing of the greeting card located behind the transparent or translucent film comprises a reflective surface such as silver or metallic card stock.

As shown in FIG. 24, front 132 of the greeting card may have a single frame-type cut-out 142. The frame-type cut-out may be plain or decorated, and preferably frames a transparent or translucent film with graphics, 144 (e.g., as shown in FIG. 25). Graphics 144 on transparent or translucent film 134 may be of any nature such as holiday scenes, humorous pictures, and the like. Light stick 140 is inserted behind transparent or translucent film 134 so that the light illuminates graphics 144 through frame-type cut-out. 142. Crease 146 allows the greeting card to be folded.

Optionally, front 132 of the greeting card may contain artwork that has multiple cut-outs for "magic windows" as shown in FIG. 26. For example, in FIG. 26, house 148 is pictured on a translucent film in varying shades of gray. When a light stick is inserted behind the translucent film, light shines through the picture, but the light is brighter in the windows and open door, imitating the light inside a home. In FIG. 27 cherubs 150 surround a Christmas tree 152 and the Christmas tree ornaments 154 are of transparent film, while the background and the Christmas tree itself 152 are dark gray. In this manner, the light stick illuminates the scene, but cherubs 150 and Christmas tree ornaments 154 are much brighter than the background.

FIG. 28 shows an illuminated collapsible cardboard shaped disposable jewelry embodiment of the present invention. This embodiment comprises a pre-designed shape, such as a box 156, star, heard, geometric animal, cartoon character, and the like, for use as disposable illuminated jewelry, such as necklaces and pins. The general size of the collapsible cardboard shaped disposable jewelry of the present invention is preferably approximately 1 square inch to 6 square inches; small enough to wear comfortably around one's neck with a cord or chain 162. The disposable jewelry can be sold in the same manner as greeting cards. The shape is three-dimensional and collapsible, comprising sections with tabs and slots for fastening together to form the three-dimensional and collapsible, comprising sections with tabs and slots for fastening together to form the three-dimensional shape. For example, a star shape comprises a folding star constructed of triangular sections, when fastened together, form a three-dimensional star. A box shape comprises six square sections that when fastened together form a three-dimensional box.

For the box-shaped collapsible disposable jewelry, a translucent film can be attached to the backside of the front section of the box. The front section of the box comprises a frame-like cut-out 158. The cut-out may be of any shape, including square and oval shapes. The translucent film shows through cut-out 158 in the front section of box 156. The translucent film can be decorated with art such as seasonal greetings, landscapes, holiday art, and the like, that shine through cut-out 158 so that cut-out 158 acts as a picture frame to the graphics on the translucent film. Chemiluminescent light stick 160 is inserted into opening 164 inside assembled box 156 behind the translucent decorated film so that the light from light stick 160 illuminates the design on the translucent film, shining through the assembled box, similar to the effect of a candle placed inside a jack-o-lantern, but without the fire hazard.

Optionally, the front surface of the box may comprise a cut-out in a particular shape, such as the shape of a Christmas tree or a Halloween cat 166, as shown in FIG. 28. The translucent film can be decorated with colored ornaments for a Christmas tree. For the Halloween cat shape 158, there need not be any translucent film at all, or the translucent film can be orange, fitted behind the Halloween cat cut-out 158.

For the star, heart 168 (see FIG. 29), animal and cartoon character shapes, instead of a frame-like cut-out, there are cut-outs for the cartoon character eyes and mouth, for example. The star-shaped configuration may have miniature star-shaped holes punched into the surface so that light stick shines light through the star-shaped holes in the star. The heart-shaped configuration may have small heart-shaped holes in the star. The heart-shaped configuration may have small heart-shaped holes 170 on its surface so that light stick 160 shines light through holes 170 heart 168 as shown in FIG. 29. Miniature holes 170 are preferably no larger than toothpick-sized, but may be larger, as desired. A similar effect can be achieved with a shamrock shaped configuration and a green light stick, as well as other holiday shaped configurations such as Christmas trees, Easter eggs, and the like.

For all embodiments of the collapsible disposable jewelry, the inside surface of the jewelry may alternatively comprise a metallic surface so that the light from the light stick is magnified. An additional option is to attach colored transparent or translucent film to the inside surface of the collapsible cardboard shapes. For example, the heart-shaped configuration may have pink transparent or translucent film adhered to the inside surface of the collapsible cardboard shape so that the light shining through the holes of the heart will appear pink, regardless of which color of light stick is used.

For the chemiluminescent illuminated shoe design, as shown in FIG. 30, heel 172 (or a portion) of the shoe comprises a clear, transparent or opaque material 174 such as lexan, lycra, plastic, glass, plexiglass and the like. Light stick 176 is inserted into transparent heel portion 174 of the sole in order to illuminate heel 172 (or a portion) of the shoe. Light stick 174 may be inserted from the bottom of heel 172 or at a connection 178 between the body of the show (which lifts up) and heel 172. Alternatively, the sole of the shoe also comprises a clear or color transparent material such as lexan, lycra, plastic, glass, plexiglass and the like. A light stick is inserted into the transparent sole of the shoe in order to illuminate the sole of the shoe.

In any of the embodiments, the light stick chamber preferably comprises an open end and a closed end or open ends having stoppers or caps for containment of the light stick. Optionally, any light stick of the various inventions may comprise a removable insert aid for ease of removal of the slight stick. Such embodiments preferably comprise materials, such as, but not limited to, wood, metal, plastic, ceramics and coated glass (for opaque portions of the ornament) and plastic or glass (for translucent or transparent portions of the ornament). Some embodiments of the invention are suitable for use as jewelry, window table, or other decorations, beads, or other novelty decoration items.

The embodiments of the present invention can be manufactured in different sizes, shapes and thicknesses. The chemiluminescent articles are activated when a seal is broken (e.g., the stick is bent and cracked) and the chemicals mix together to cause the lighting. Likewise, the chemiluminescent articles may be small or large slight sticks, disks or other shapes.

Multicolored fiber optics powered by light sticks may also be utilized. This makes product design possibilities endless. The present invention eliminates the need for batteries to light up objects.

The embodiments of the present invention can be made of numerous materials such as plastic, precious and semi-precious metals, ceramic, glass, cloth, leather, stone, and the like.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An illuminated item of clothing comprising:

a clothing article;

a pocket comprising a transparent, translucent, opaque or cut-out face and for receiving a chemiluminescent article;

a chemiluminescent article removably disposable within said pocket and illuminating said face of said pocket when said chemiluminescent article is activated; and at least one holder for holding and storing at least one unactivated additional light stick.

2. The item of clothing of claim 1 comprising at least one member selected from the group consisting of a that, cap, shirt, pants, collar, cuff, sleeve, pocket, trim, scarf, boa, shoe and sandal.

3. The item of clothing of claim 1 wherein said face comprises a mesh material.

4. The item of clothing of claim 1 wherein said face comprises a decorative item to be illuminated.

5. The item of clothing of claim 1 wherein said chemiluminescent article comprises a light stick.

6. An illuminated item comprising:

a scarf to be illuminated;

at least one chemiluminescent article; and at least one fiber optic strand lighted by said chemiluminescent article.

7. The item of claim 6 further comprising at least one ornament distant from said chemiluminescent article and connected to said fiber optic strand and lit by said chemiluminescent article via said fiber optic strand.

8. An illuminated collapsible item comprising:

a geometric shape comprising a collapsed and flat unfolded form and an assembled three-dimensional form, said form comprising light openings allowing light from said activated chemiluminescent article to shine through;

an opening for receiving a chemiluminescent article; and a chemiluminescent article removably disposable within said opening for lighting said item in its assembled state when said chemiluminescent item is activated.

9. The illuminated item of claim 8 wherein said item comprises jewelry.

10. The illuminated item of claim 8 wherein said assembled form comprises a shape selected from the group consisting of a box, heart, star, animal, cartoon character, shamrock, tree, egg, and a shape representative of a holiday.

11. The illuminated item of claim 8 further comprising a cut-out.

12. The illuminated item of claim 11 further comprising a transparent, translucent or opaque film.

13. The illuminated item of claim 12 further comprising graphics on said film.

14. An illuminated collapsible item comprising:

a geometric shape comprising a collapsed and flat unfolded form and an assembled three-dimensional form;

an opening for receiving a chemiluminescent article;

a chemiluminescent article removably disposable within said opening lighting said item in its assembled state when said chemiluminescent item is activated; and a cut-out.

15. The illuminated item of claim 14 wherein said item comprises jewelry.

16. The illuminated item of claim 14 wherein said assembled form comprises a shape selected from the group consisting of a box, heart, star, animal, cartoon character, shamrock, tree, egg, and a shape representative of a holiday.

17. The illuminated item of claim 14 further comprising a transparent, translucent or opaque film.

18. The illuminated item of claim 17 further comprising graphics on said film.

19. An illuminated item comprising:

a boa to be illuminated;

at least one chemiluminescent article; and at least one fiber optic strand lighted by said chemiluminescent article.

20. The item of claim 19 further comprising at least one ornament distant from said chemiluminescent article and connected to said fiber optic strand and lit by said chemiluminescent article via said fiber optic strand.

21. An illuminated item comprising:

a collar to be illuminated;

at least one chemiluminescent article; and at least one fiber optic strand lighted by said chemiluminescent article.

22. The item of claim 21 further comprising at least one ornament distant from said chemiluminescent article and connected to said fiber optic strand and lit by said chemiluminescent article via said fiber optic strand.

23. An illuminated item comprising:

a trim to be illuminated;

at least one chemiluminescent article; and at least one fiber optic strand lighted by said chemiluminescent article.

24. The item of claim 23 further comprising at least one ornament distant from said chemiluminescent article and connected to said fiber optic strand and lit by said chemiluminescent article via said fiber optic strand.

* * * * *